US006591723B1

(12) United States Patent
Jung

(10) Patent No.: US 6,591,723 B1
(45) Date of Patent: Jul. 15, 2003

(54) SLICED MEAT SEPARATING AND GUIDE DEVICE FOR MEAT SLICERS

(75) Inventor: Un Jo Jung, Seoul (KR)

(73) Assignee: Big Sum Techno Co., Ltd., Sihung (KR)

( * ) Notice: Subject to any disclaimer, the term of this patent is extended or adjusted under 35 U.S.C. 154(b) by 0 days.

(21) Appl. No.: 09/593,164

(22) Filed: Jun. 14, 2000

(30) Foreign Application Priority Data

Jun. 14, 1999 (KR) ..... 1999-22041

(51) Int. Cl.[7] ..... B26D 7/06
(52) U.S. Cl. ..... 83/116; 105/932
(58) Field of Search ..... 83/109, 932, 111, 83/113, 114, 116, 117, 698.41, 698.51, 698.61; 30/357, 347

(56) References Cited

U.S. PATENT DOCUMENTS 3,139,128 A * 6/1964 Urschel et al. ..... 83/111
3,820,194 A * 6/1974 Thiesen ..... 83/113
4,896,708 A * 1/1990 Dietz ..... 83/105 X
5,253,686 A * 10/1993 Dietz ..... 83/105 X
5,609,519 A * 3/1997 Townsend ..... 83/105 X
5,724,874 A * 3/1998 Lindee et al. ..... 83/932 X
5,787,776 A * 8/1998 Nishimoto ..... 83/932 X
5,860,343 A * 1/1999 Koch et al. ..... 83/105 X
6,116,130 A * 9/2000 Cogan ..... 83/932 X
6,129,488 A * 10/2000 Fahr ..... 83/545 X
6,148,709 A * 11/2000 Bucks ..... 83/932 X

* cited by examiner

*Primary Examiner*—Charles Goodman
(74) *Attorney, Agent, or Firm*—Jacobson Holman PLLC

(57) ABSTRACT

A sliced meat separating and guide device for meat slicers is disclosed. This device separates sliced meat from the blade and guides the sliced meat to drop the sliced meat from the blade onto a support surface. In the device, a plate is positioned around the blade in a way such that the horizontal and vertical positions of the plate relative to the blade are adjustable. In another embodiment, a concaved portion is formed along the inclined portion between the blade body and the sharpened edge of the blade, and so a space is formed between the concaved portion and the sliced meat, thus preventing a formation of a water screen between the sliced meat and the blade during a meat slicing operation. In such a case, a shoulder is formed along the outside edge of the concaved portion, thus guiding the sliced meat outwardly from the blade. The sliced meat separating and guide device of this invention thus allows the sliced meat to be dropped from the blade onto a conveyor unit while being spread out. The sliced meat is thus free from folding or lumping. This finally maintains a desired appearance of the sliced meat and allows the sliced meat to induce consumers to buy it.

10 Claims, 6 Drawing Sheets

FIG 1
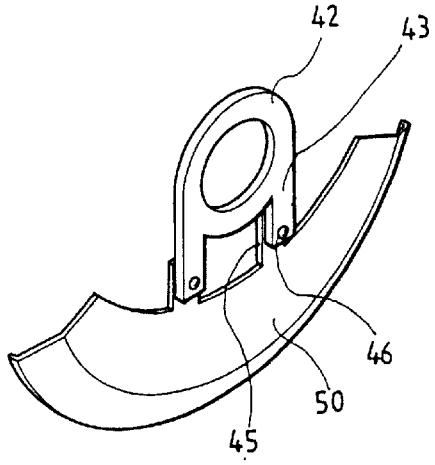
FIG 2
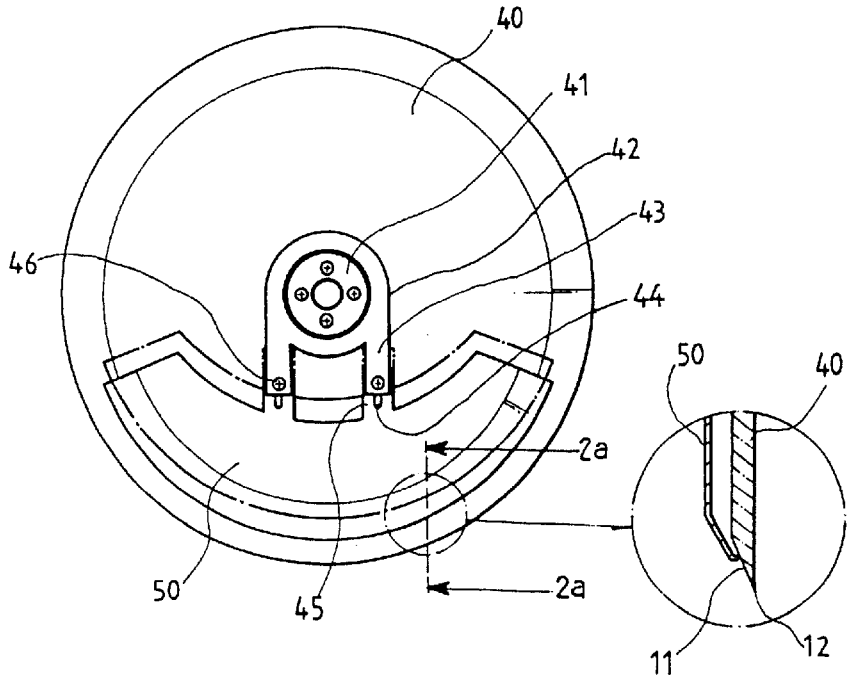
FIG 2a

FIG 5
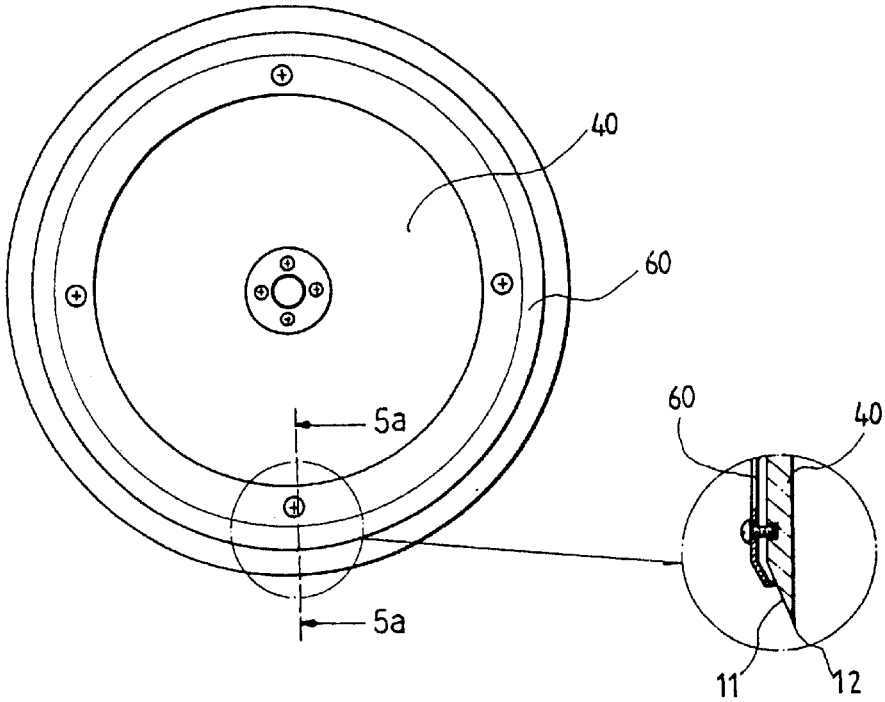
FIG 5a
FIG 6
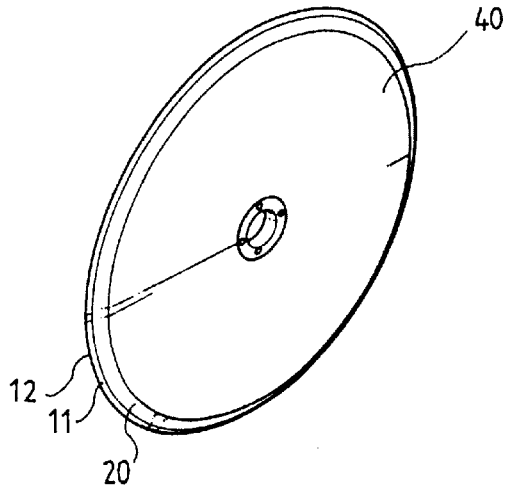

SLICED MEAT SEPARATING AND GUIDE DEVICE FOR MEAT SLICERS

BACKGROUND OF THE INVENTION

1. Field of the Invention

The present invention relates, in general, to meat slicers used for slicing meat and, more particularly, to a sliced meat separating and guide device for such slicers, the device being designed to effectively separate sliced pieces of meat from a thin-bladed cutter of a slicer and to guide the sliced pieces in a desired direction during a meat slicing operation.

2. Description of the Prior Art

A variety of meat processing machines, such as refrigerators, freezers, meat slicers, meat cutting machines, bone cutting machines, and fat separating machines, have been proposed and preferably used in the prior art.

The conventional meat slicer, used for slicing meat into thin pieces, typically comprises a thin-bladed cutter, a meat support, and a slice thickness adjusting plate. The meat support holds meat thereon and feeds the meat to the bladed cutter, thus allowing the blade to slice the meat into desired thin pieces. The gap between the slice thickness adjusting plate and the blade is controlled to set a thickness of sliced meat as desired.

During a meat slicing operation of such a conventional slicer, a water screen is formed between each of the sliced pieces of meat and the smooth surface of the blade due to moisture and blood laden in the meat. Such a water screen cooperates with a vacuum formed between each sliced piece of meat and the smooth surface of the blade, thus forming absorption force on the smooth surface of the blade. This finally allows the sliced meat to be undesirably attached under pressure to the smooth surface of the blade.

Such a conventional meat slicer thus forces a user to manually separate the sliced pieces of meat from the blade one by one during the meat slicing operation. However, it is difficult to quickly and precisely perform such a sliced meat separating action, and so the sliced pieces of meat may easily collect on the blade and may be pressurized, thus being reduced in taste and freshness.

That is, since the sliced pieces of meat are very thin and are laden with moisture and blood, they fail to be easily removed from the smooth surface of the blade, but are undesirably attached under pressure to the smooth surface of the blade due to both a water screen and a vacuum formed between the sliced meat and the smooth surface of the blade. When the blade, with the attached sliced pieces of meat on its smooth surface, is continuously rotated, the sliced pieces of meat undesirably fold and lump and are undesirably recut.

Such a problem is also experienced in conventional kitchen blades. In an effort to overcome such a problem, some kitchen blades having holes or blooding grooves have been proposed and used. The object of such holes or blooding grooves formed on the kitchen blades is to form a space between the sliced meat and the smooth surface of a blade and to eliminate a water screen between the sliced meat and the blade, thus finally allowing the sliced meat to be easily separated from the blade.

Such holes or blooding grooves somewhat accomplish their operational object in the case of kitchen blades. However, when an exceeding number of holes or grooves are formed on a kitchen blade, the structural strength of the blade is reduced. This may cause the blade to be easily broken when the blade is impacted. On the contrary, when the number of holes or grooves as less than a desired number, this enlarges the interval between the holes or grooves. In such a case, the holes or grooves may fail to desirably prevent the sliced pieces of meat from being attached under pressure to the smooth surface of the blade. The holes or grooves also cause a hygienic problem due to dregs settled in the holes. It is very difficult to remove such dregs from the holes or grooves. Such holes or grooves are not used in the high speed rotating blades of motored slicers since the holes or grooves undesirably generate pneumatic frictional noise and pneumatic frictional resistance, thus disturbing a smooth rotating action of the blade. In addition, such holes or grooves may cause the blade of a motored slicer to break, thus sometimes causing safety hazards to users.

In an effort to overcome such problems experienced in the conventional meat slicers, Korean Patent Application No. 98-32,948 discloses a motored slicer having a plurality of air jet nozzle on one surface of a high speed rotating circular or semicircular blade. In this slicer, pressurized air is ejected from the air jet nozzles and pneumatically separates the sliced pieces of meat from the smooth surface of the blade.

The above Korean slicer somewhat effectively separates the sliced meat from the smooth surface of the blade. However, this slicer has a complex construction, and so it is thus very difficult to fabricate the slicer. This slicer is also undesirably increased in manufacturing cost. Another problems of the above slicer resides in that it is very difficult to precisely control the air pressure capable of effectively separating the sliced meat from the blade.

SUMMARY OF THE INVENTION

Accordingly, the present invention has been made keeping in mind the above problems occurring in the prior art, and an object of the present invention is to provide a sliced meat separating and guide device for meat slicers, which has a plate positioned around the blade in a way such that the horizontal and vertical positions of the plate relative to the blade are adjustable.

The device may comprise a concaved portion, which is formed along the inclined portion between the blade body and the sharpened edge of the blade. In such a case, a space is formed between the concaved portion and sliced meat, thus preventing a formation of a water screen between the sliced meat and the blade during a meat slicing operation. A shoulder is formed along the outside edge of the concaved portion, thus guiding he sliced meat outwardly from the blade. The sliced meat separating and guide device of this invention allows the sliced meat to be dropped from the blade onto conveyor unit while being spread out. The sliced meat is thus free from folding or lumping. This finally maintains a desired appearance of the sliced meat and allows the sliced meat to induce consumers to buy it.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a perspective view of a sliced meat separating and guide device in accordance with a first embodiment of the present invention;

FIG. 2 is a front view, showing the operation of the sliced meat separating and guide device of the first embodiment;

FIG. 2*a* is an enlarged cross sectional view taken along the line 2*a*—2*a* of the circled portion of FIG. 2;

FIG. 5 is a front view, showing the operation of the sliced meat separating and guide device of FIG. 4;

FIG. 5*a* is an enlarged cross sectional view taken along the line 5*a*—5*a* of the circled portion of FIG. 5;

FIG. 6 is a perspective view of a sliced meat separating and guide device in accordance with a third embodiment of the present invention;

DESCRIPTION OF THE PREFERRED EMBODIMENTS

Figure 3:
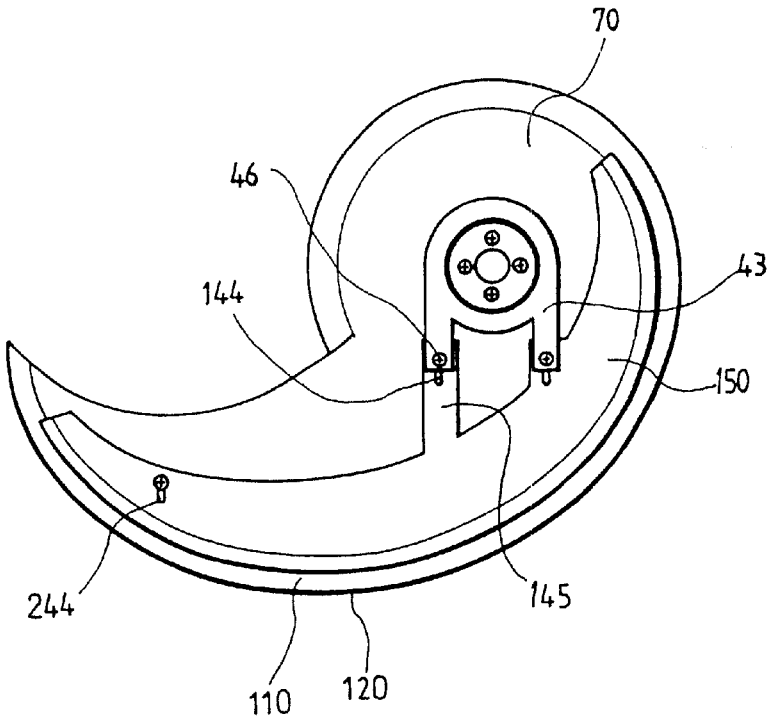
FIG. 3 is a front view of a modification of the first embodiment of the sliced meat separating and guide device of FIG. 1.
Figure 7:
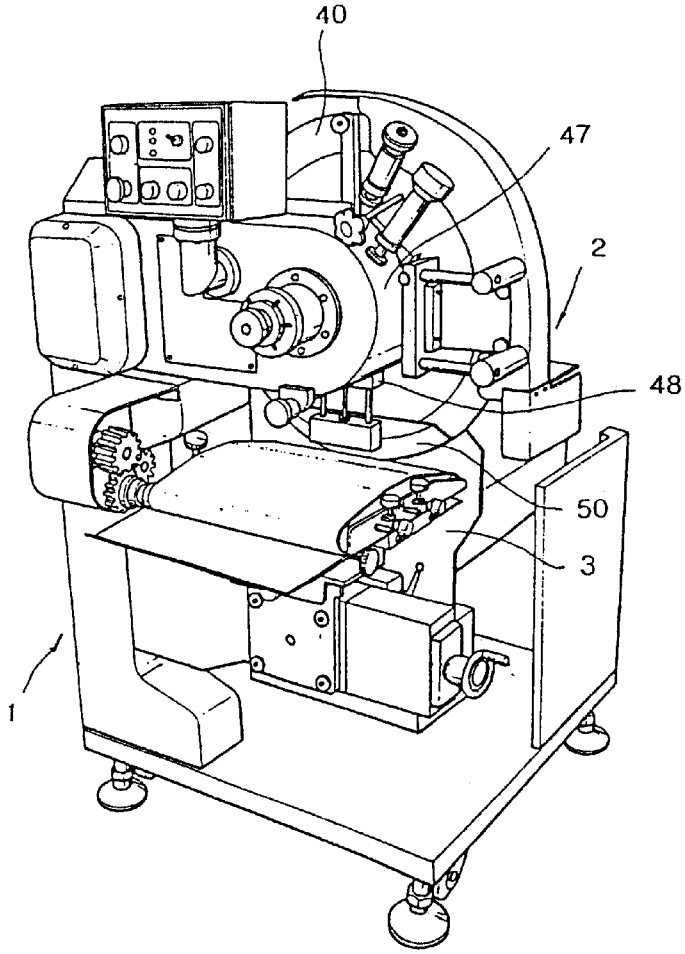
FIG. 7 is a perspective view of a meat slicer having the sliced meat separating and guide device according to the present invention.
Figure 8:
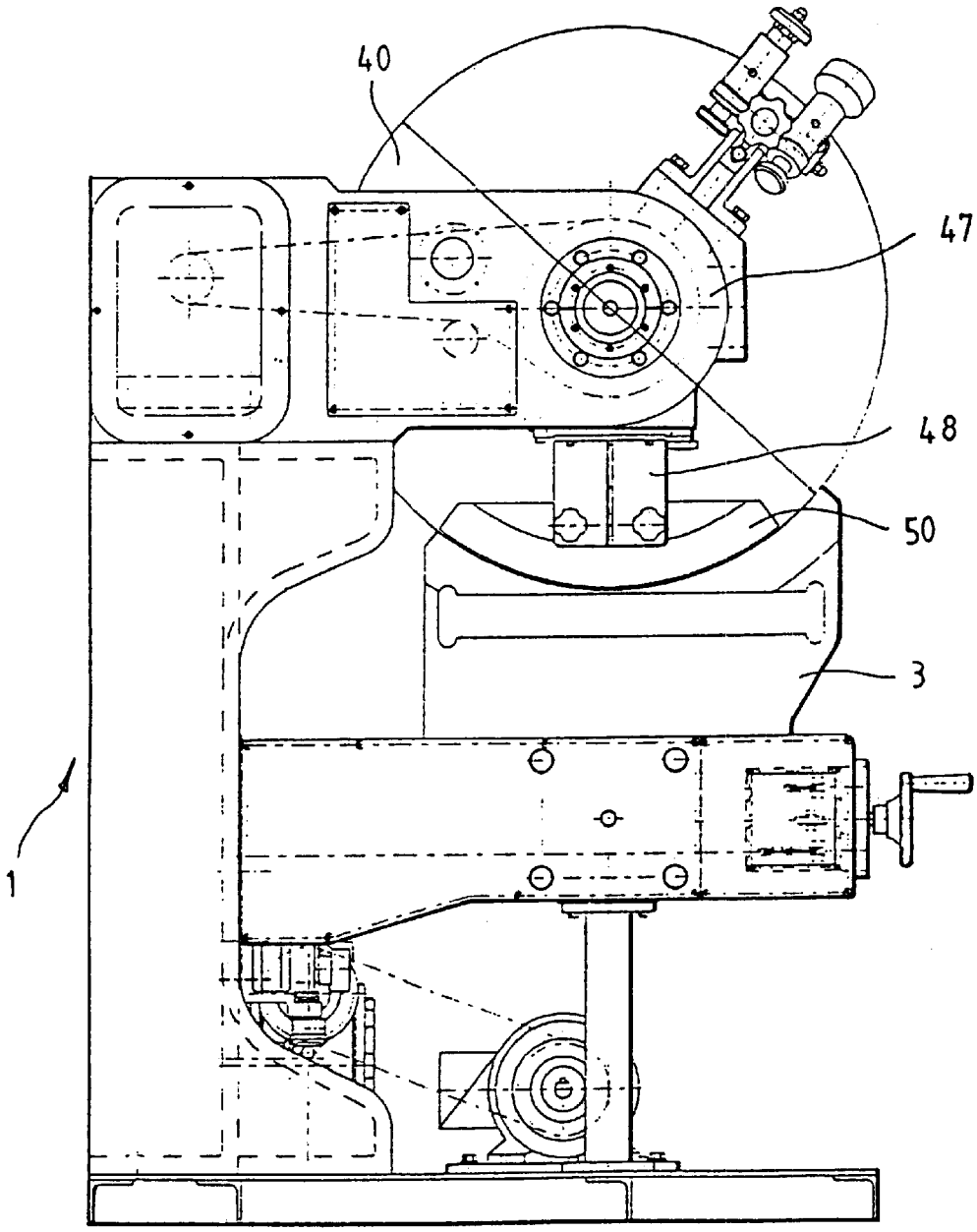
FIG. 8 is a front view of the meat slicer having the sliced meat separating and guide device of this invention.

FIG. 1 is a perspective view of a sliced meat separating and guide device for meat slicers in accordance with a first embodiment of the present invention. FIGS. 2 and 3 are front views, showing the operation of the sliced meat separating and guide device of the first embodiment and of a modification of the first embodiment; an enlarged view of the circled portion in FIG. 2 is shown in FIG. 2*a*. FIG. 7 is a perspective view of a meat slicer having the sliced meat separating and guide device of this invention. FIG. 8 is a front view of the meat slicer having the sliced meat separating and guide device of this invention.

As shown in the drawings, the blade, used with the sliced meat separating and guide device of this invention, may be a circular blade 40 or a chop cutter 70. The circular blade includes a blade body 10, an inclined portion 11 and a sharpened edge 12. The chop cutter includes an inclined portion 110 and a sharpened edge 120.

The sliced meat separating and guide device of this invention comprises a locking boss 42, which is fitted over the rotating shaft 41 of the blade 40. Two support arms 43 are integrated with the locking boss 42, with a sliced meat separate and guide plate 50 being assembled with the two arms 43. In such a case, the position of the guide plate 50 relative to the arms 43 is adjustable.

The above guide plate 50 is an arc-shaped plate, of which the radius of curvature is smaller than the radius of the blade 40. During a meat slicing operation, sliced meat is separated from the blade 40 by the edge of the guide plate 50. In such a case, the guide plate 50 also guides the sliced meat so as to neatly drop the sliced meat onto a support surface while spreading out the sliced meat without allowing the sliced meat to be undesirably folded.

The sliced meat separating and guide device installed on a slicer is shown in FIGS. 7 and 8.

In the sliced meat separating and guide device of this invention, the locking boss 42 is fitted over the rotating shaft 41 of the blade 40. The two support arms 43 are integrated with the locking boss 42, with a hole being formed on each of the two arms 43. On the other hand, two connection arms 45 are integrated with the guide plate 50 at positions corresponding to the two support arms 43. A longitudinal hole 44 is formed on each of the two connection arms 45. Each of the connection arms 45 of the guide plate 50 is coupled to an associated support arm 43 by a locking bolt 46 passing through the two holes of two arms 43 and 45. The arc-shaped guide plate 50 has a radius of curvature smaller than the radius of the blade 40. Sliced pieces of meat are thus effectively separated from the blade 40 and are guided by the edge of the guide plate 50 during a meat slicing operation.

In the slicer of FIGS. 7 and 8, the guide prate 50 is movable in a vertical direction under the guide of a guider that is movably held on the support 48 of a blade unit 47. A locking bolt fixes the adjusted position of the plate 50.

In the embodiment of this invention, the arc-shaped plate 50 is installed around the blade 40 in a way such that the plate 50 is adjustable in its vertical position relative to the blade 40. Of course, it should be understood that the structure for adjusting the position of the plate 50 relative to the blade may be changed without affecting the functioning of this invention.

FIG. 3 shows a modification of the first embodiment of the device of this invention used with a conventional chop cutter 70 in place of the circular blade 40. Of course, the construction and operation of the device of FIG. 3 remain the same as those of FIGS. 2 and 2*a*.

That is, the sliced meat separating and guide device of FIG. 3 comprises a locking boss 42, which is fitted over the rotating shaft 41 of the chop cutter 70. Two support arms 43 are integrated with the locking boss 42, with a hole being formed on each of the two arms 43. On the other hand, two connection arms 145 are integrated with a sliced meat separate and guide plate 150 at positions corresponding to the two support arms 43. A longitudinal hole 144 is formed on each of the two connection arms 145. Each of the connection arms 145 of the guide plate 150 is coupled to an associated support arm 43 by a locking bolt 46 passing through the two holes of two arms 43 and 145. The sliced meat separate and guide plate 150 is thus coupled to the chop cutter 70 in a way such that the position of the plate 150 relative to the chop cutter 70 is adjustable as desired.

The edges of both the plate 50 and a guide ring 60 may be rounded or sharpened and are preferably positioned around the inclined portion 11 of the blade 40 at a position capable of accomplishing a desired operational effect. Such a construction remains in the case of the sliced meat separating and guide device used with the chop cutter 70 or a wide plate blade 71.

Figure 4:
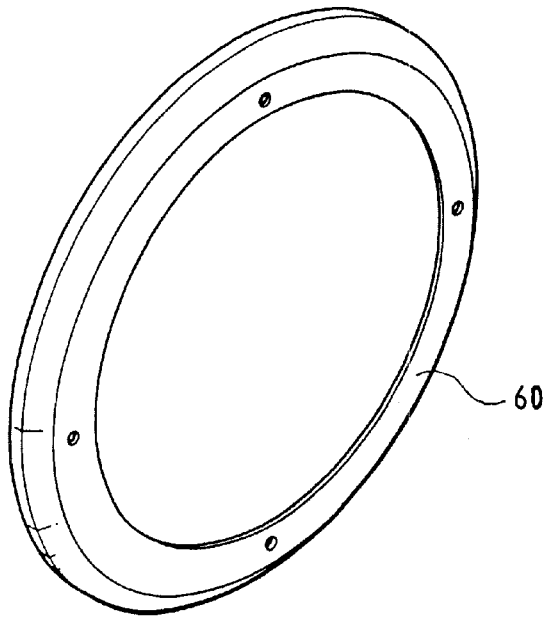
FIG. 4 is a perspective view of a sliced meat separating and guide device in accordance with a second embodiment of the present invention.

FIG. 4 is a perspective view of a sliced meat separating and guide device in accordance with the second embodiment of the present invention. FIG. 5 is a front view, showing the operation of the sliced meat separating and guide device of FIG. 4, with an enlarged view of the circled portion shown in FIG. 5*a*. In the device of the second embodiment, a sliced meat separate and guide ring 60 is screwed to one surface of the circular blade 40, thus separating sliced meat from the blade 40 and guiding the sliced meat outwardly from the blade 40.

Figure 6A:
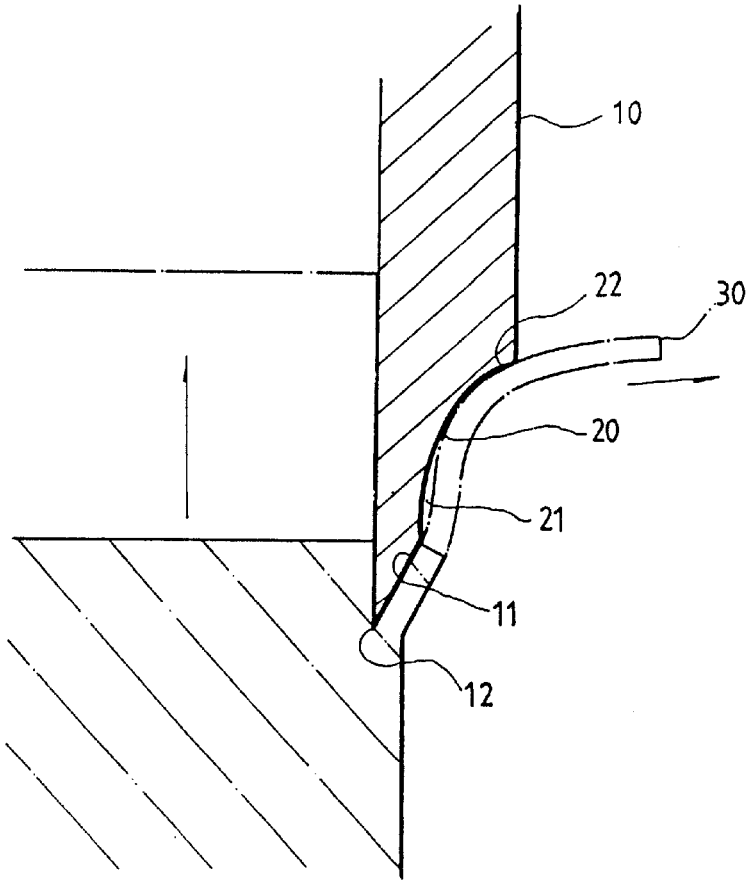
FIG. 6*a* is a side view, showing the blade in operation of the sliced meat separating and guide device according to the third embodiment of the present invention.
Figure 6B:
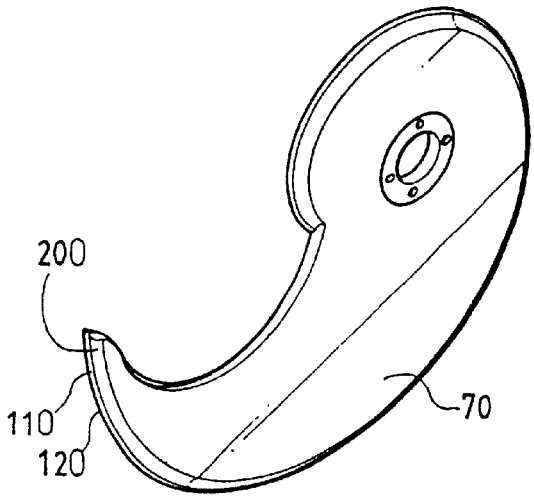
FIG. 6*b* is a perspective view of a modification of the third embodiment of the sliced meat separating and guide device of FIG. 6.
Figure 6C:
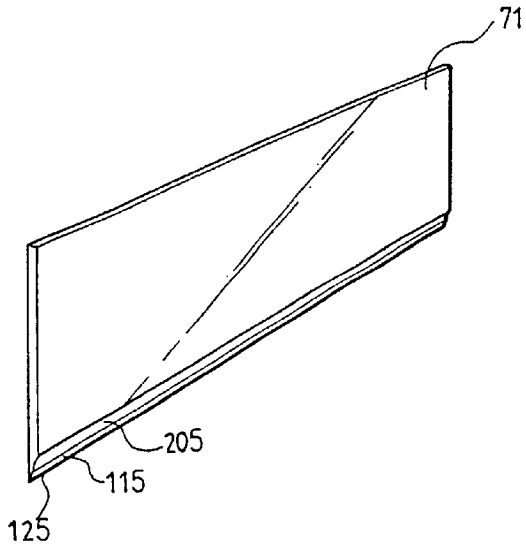
FIG. 6*c* is a perspective of a further modification of the third embodiment of the sliced meat separating and guide device of FIG. 6.

FIG. 6 is a perspective view of a sliced meat separating and guide device in accordance with the third embodiment of the present invention. FIG. 6*a* is a side view, showing the blade in operation of the sliced meat separating and guide device according to the third embodiment of the present invention. FIG. 6*b* is a perspective view of a modification of the third embodiment, and FIG. 6*c* is a perspective of a further modification of the third embodiment of the sliced meat separating and guide device. As shown in FIG. 6*a*, a concaved portion 20 is formed along the inclined portion 11 between the blade body 10 and the sharpened edge 12. During a meat slicing operation of the blade, a space 21 is formed between the concaved portion 20 and the sliced meat 30, thus preventing a water screen from being formed between the sliced meat 30 and the blade. A shoulder 22 is formed along the outside edge of the concaved portion 20 and acts as a means for guiding the sliced meat outwardly from the blade.

That is, the concaved portion 20 according to the third embodiment prevents the sliced meat 30 from being attached under pressure to the blade body 10, thus allowing the blade to effectively slice the meat into thin pieces without failure.

In the drawings, the reference numeral 1 denotes a slicer, 2 denotes a meat support, and 3 denotes a slice thickness adjusting plate.

The operational effect of the above device will be described herein below.

As shown in FIGS. 1, 2, 2*a*, 3, 7 and 8, the sliced meat separating and guide device according to the first embodiment of this invention comprises the locking boss 42, which is fitted over the rotating shaft 41 of the blade 40 installed at the slicer 1. The two support arms 43 are integrated with the locking boss 42, while the guide plate 50, 150 is connected to the support arms 43 in a way such that the plate 50, 150 is adjustable in its vertical position relative to the blade 40, 70.

The adjusted position of the plate 50 is fixed by a locking bolt.

In the primary embodiment of this invention, the arc-shaped plate 50 has a radius of curvature smaller than the radius of the blade 40.

During a meat slicing operation, sliced pieces 30 or meat are moved along the sharpened edge 12 and come into contact with the plate 50, thus being separated from the blade 40 and being neatly and stably dropped from the blade 40 onto a conveyor unit while being spread out.

Therefore, the slicer, having the sliced meat separating and guide device of this invention, almost completely overcomes the problems experienced in the conventional slicers.

FIG. 3 shows the device of this invention used with a conventional chop cutter 70 in place of the circular blade 40. Of course, the construction and operation of the device of FIG. 3 remain the same as those of FIG. 2.

In the embodiment of FIG. 3, it is preferable to additionally hold the plate 150 to the chop cutter 70 at a position remote from the connection arms 145 of the plate 150 using an additional locking means through hole 244 since the chop cutter 70 has a longitudinal shape. Of course, the device according to the first embodiment of this invention may be preferably used with a wide plate blade 71 as shown in FIG. 6*c* without affecting the functioning of this invention.

FIG. 4 shows the construction of the sliced meat separating and guide device in accordance with the second embodiment of this invention. FIG. 5 is a front view, showing the operation of the sliced meat separating and guide device of FIG. 4, with an enlarged view of the circled portion shown in FIG. 5*a*. In the device according to the second embodiment, the sliced meat separate and guide ring 60 is screwed to one surface of the circular blade 40, thus separating sliced meat from the blade 40 and guiding the sliced meat outwardly from the blade 40. However, with this embodiment it can be difficult to adjust the position of the ring 60 relative to the blade 40.

FIG. 6 shows the sliced meat separating and guide device in accordance with the third embodiment of the present invention. FIG. 6*a* is a side view, showing the blade in operation of the sliced meat separating and guide device according to the third embodiment of the present invention. FIG. 6*b* is a perspective view of a modification of the third embodiment, and FIG. 6*c* is a perspective of a further modification of the third embodiment of the sliced meat separating and guide device. As shown in the drawings, a concaved portion 20, 200, 205 is formed along the inclined portion 11, 110, 115 between the blade body and the sharpened edge 12, 120, 125. During a meat slicing operation of the blade, a space 21 is formed between the concaved portion 20, 200, 205 and the sliced meat 30, thus preventing a water screen from being formed between the sliced meat 30 and the blade. A shoulder 22 is formed along the outside edge of the concaved portion 20, 200, 205 and acts as a means for guiding the sliced meat outwardly from the blade. That is, the sliced meat separating and guide device according to the third embodiment is free from the plate 50, 150 and so it is easy to produce the device.

In a brief description, the sliced meat separating and guide device for slicers of this invention prevents sliced meat From being attached under pressure to the smooth surface of a blade due to a water screen and a vacuum formed between the sliced meat and the smooth surface of the blade. That is, the device of this invention effectively separates sliced meat from the smooth surface of the blade and guides the sliced meat in a desired direction, thus allowing the slicer to be free from damaging the sliced meat. Since the device of this invention has a simple construction, it is easy to produce the device at a low production cost. The device also improves work efficiency while slicing meat and maintains a desired appearance of the sliced meat, thus allowing the sliced meat to induce consumers to buy it.

As described above, the present invention provides a sliced meat separating and guide device for meat slicers. This device effectively separates sliced meat from the smooth surface of a blade and guides the sliced meat in a desired direction, thus preventing the sliced meat from being attached under pressure to the smooth surface of the blade due to a water screen and a vacuum formed between the sliced meat and the smooth surface of the blade. The device also allows the sliced meat to be dropped from the blade onto a conveyor unit while being spread out, and so the sliced meat is free from folding or lumping. This finally maintains a desired appearance of the sliced meat and allows the sliced meat to induce consumers to buy it. Another advantage of the device of this invention resides in that it has a simple construction and is easily produced at a low production cost.

Although the preferred embodiments of the present invention have been disclosed for illustrative purposes, those skilled in the art will appreciate that various modifications, additions and substitutions are possible, without departing from he scope and spirit of the invention as disclosed in the accompanying claims.

What is claimed is:

1. A sliced meat separating and guide device for use with a meat slicer having a circular blade, comprising:

an arc-shaped plate having a radius of curvature smaller than a radius of the circular blade such that said blade extends beyond an outer edge of said plate, said blade including a blade body, an inclined portion and a sharpened edge; and means for holding said arc-shaped plate on a slicer housing at a position around the blade in a way such that horizontal and vertical positions of said plate relative to said blade are adjustable;

said arc-shaped plate sloping toward said outer edge and substantially in line with said inclined portion so as to separate the sliced meat from the blade and guide the sliced meat to drop the sliced meat from the blade onto a support surface while spreading the sliced meat out.

2. The device according to claim 1, wherein said holding means includes a locking boss fitted over a rotating shaft of the blade, with two support arms being integrated with the locking boss, two connection arms being integrated with said arc-shaped plate and individually having a longitudinal hole, said plate being thus connected to the support arms by locking bolts passing through the longitudinal holes.

3. The device according to claim 1, wherein said arc-shaped plate includes a sliced meat separate and guide ring mounted to one surface of said circular blade, said ring having a circumference less than a circumference of said circular blade, a sloped portion of said ring along said inclined portion separating the sliced meat from the blade and guiding the sliced meat outwardly from the blade.

4. A sliced meat separating and guide device for use with a meat slicer having a blade with a curved cutting portion, comprising:

a generally arc-shaped plate having a radius of curvature smaller than a radius of said curved cutting portion such that said cutting portion of said blade extends beyond an outer edge of said plate, said blade including an inclined portion and a sharpened edge; and means for holding said generally arc-shaped plate on a slicer housing at a position around the blade in a way such that horizontal and vertical positions of said plate relative to said cutting portion of said blade are adjustable;

said outer edge of said plate sloping toward said blade to end substantially along said inclined portion, the slope of said plate acting to separate the sliced meat from the blade and guide the sliced meat to drop from the blade onto a support surface while spreading the sliced meat out.

5. The device according to claim 4, wherein the blade is circular.

6. The device according to claim 5, wherein said arc-shaped plate includes a sliced meat separate and guide ring mounted to one surface of said circular blade, said ring having a circumference less than a circumference of said circular blade, a sloped portion of said ring along said inclined portion separating the sliced meat from the blade and guiding the sliced meat outwardly from the blade.

7. The device according to claim 5, wherein said two connecting arms are of substantially equal length.

8. The device according to claim 4, wherein the blade is a chop cutter.

9. The device according to claim 8, wherein said two connecting arms are of substantially equal length.

10. The device according to claim 4, wherein said holding means includes a locking boss fitted over a rotating shaft of the blade, with two support arms being integrated with the locking boss, two connection arms being integrated with said generally arc-shaped plate and individually having a longitudinal hole, said plate being thus connected to the support arms by locking bolts passing through the longitudinal holes.

* * * * *